United States Patent [19]

Iiyama et al.

[11] Patent Number: 5,071,825

[45] Date of Patent: Dec. 10, 1991

[54] THERMAL TRANSFER RECEIVER

[75] Inventors: Kiyotaka Iiyama; Anthony J. Nelson, both of Ibaraki, Japan

[73] Assignee: Imperial Chemical Industries PLC, England

[21] Appl. No.: 453,322

[22] Filed: Dec. 22, 1989

[30] Foreign Application Priority Data

Dec. 22, 1988 [GB] United Kingdom ..... 8830011

[51] Int. Cl.[5] ..... B41M 5/035; B41M 5/26

[52] U.S. Cl. ..... 503/227; 8/471; 428/195; 428/211; 428/335; 428/336; 428/480; 428/481; 428/910; 428/913; 428/914

[58] Field of Search ..... 8/471; 428/195, 480, 428/913, 914, 211, 335, 336, 481, 910; 503/227

[56] References Cited

U.S. PATENT DOCUMENTS 4,935,402 6/1990 Imai et al. ..... 428/480

FOREIGN PATENT DOCUMENTS 0312637 4/1989 European Pat. Off. ..... 503/227

*Primary Examiner*—Bruce H. Hess

*Attorney, Agent, or Firm*—Cushman, Darby & Cushman

[57] ABSTRACT

A receiver sheet for dye diffusion thermal transfer printing comprises a white molecularly oriented polyester film, supporting a layer of dye-receptive material on one surface, the other surface of the film being laminated to an undersheet of higher compliance than the film, and the thickness of the film lying within the range 10 to 50 μm. The undersheet increases the effective compliance of the receiver, increasing the area heated during printing thereby to give better pixel transfer.

9 Claims, 1 Drawing Sheet

THERMAL TRANSFER RECEIVER

Figure 1:
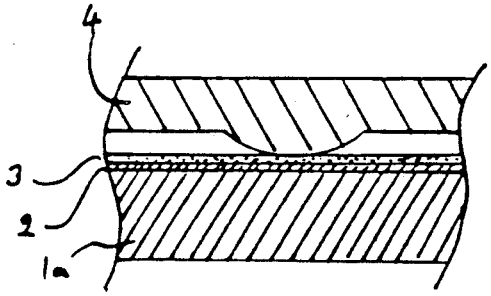

The invention relates to thermal transfer printing, and especially to receiver sheets of novel construction and their use in dye-diffusion thermal transfer printing, using a thermal printing head.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°-220° C. for a period of 30-120 s, to transfer substantially all of the dye.

A more recent TTP process is one in which prints can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern to be printed already preformed on the dyesheet, a dyesheet is used which comprises a thin substrate supporting a dyecoat comprising a single dye or dye mixture (usually dispersed or dissolved in a binder) forming a continuous and uniform layer over an entire printing area of the dyesheet. Printing is then effected by heating selected discrete areas of the dyesheet while the dyecoat is held against a dye-receptive surface, causing dye to transfer into the corresponding areas of that receptive surface. The shape of the pattern transferred is determined by the number and location of the discrete areas which are subjected to heating, and the depth of shade in any discrete area is determined by the period of time for which it is heated and the temperature reached. The transfer mechanism appears to be one of diffusion into the dye-receptive surface, and such printing process has been referred to as dye-diffusion thermal transfer printing.

This process can give a monochrome print in a colour determined by the dye or dye-mixture used, but full colour prints can also be produced by printing with different coloured dyecoats sequentially in like manner. The latter may conveniently be provided as discrete uniform print-size areas, in a repeated sequence along the same dyesheet.

High resolution printing can be effected by making the heated areas very small and close together, to transfer correspondingly small individual pixels, or groups of such pixels, to the receiver. For example, a typical thermal print head has a row of tiny heaters which print six or more pixels per millimeter, generally with two heaters per pixel. The greater the density of pixels, the greater is the potential resolution, but as presently available printers can only print one row at a time, it is desirable to print them at high speed with short hot pulses, usually from near zero up to about 10 ms, but even up to a maximum of 15 ms in some printers, with each pixel temperature typically rising to about 350° C. during the longest pulses.

A typical receiver sheet consists essentially of a substrate coated with a dye-receptive layer of a composition having an affinity for the dye molecules and into which they can readily diffuse when the dyesheet is heated during printing. Such dye-receptive layers are typically around 2-6 μm thick. Various sheet materials have been suggested for the substrate, including for example, cellulose fibre paper, thermoplastic films such as molecularly oriented films of synthetic linear polyesters (e.g. biaxially oriented and heat set polyethyleneterephthalate film), and plastic films voided to give them paper-like handling qualities (hence generally referred to as "synthetic paper"). A typical paper receiver is about 150 μm thick. These different sheet materials each have their individual strengths and weaknesses, it being disclosed in EP-A-234,563, for example, that synthetic papers tend to curl when heated during printing, unless one or more other sheets are laminated to the back of the paper to balance the receptive layer on the front.

Paper substrates, whether synthetic or cellulosic and including the above laminates, are limited in their whiteness by their inherent properties and structures, and it does not appear to be possible to obtain the high surface gloss desirable for many applications. More recently, stable thermoplastic films, such as white molecularly oriented polyester films have been proposed for receiver substrates, a typical thickness being about 125 μm. These generally contain both voids and particulate solids such as finely divided inorganic materials and polymeric materials, for giving the opacity and whiteness. Examples of such films include Melinex 990, this being a voided film containing finely divided barium sulphate particles, a combination which produces a particularly white and opaque film ("Melinex" is a Registered Trade Mark of Imperial Chemical Industries PLC). Receiver sheets using such films are described, for example, in our EP-A-292,109, as we had found that the high gloss and improved whiteness of white molecularly oriented films, could be substantially retained during printing to give clear, bright, high-quality prints with colours enhanced by the very white background. However, we have now found that even these can be improved.

When using microphotographic techniques to examine prints made on receivers having white polyester film substrates, we discovered that solid blocks of colour which had been transferred by some printers, would often have white gaps between adjacent pixels. In extreme cases, columns of interpixel spaces could manifest themselves as very fine white lines transverse to the direction of travel through the printer, and be clearly visible through a microscope. We have now found a way of reducing, or even avoiding, such gaps, and even though such interpixel gaps may be hardly visible to the naked eye, colours printed onto the same white and glossy surfaces without such gaps, can be noticeably enhanced.

According to a first aspect of the present invention, a receiver sheet for dye diffusion thermal transfer printing comprises a white molecularly oriented polyester film, supporting a layer of dye-receptive material on one surface, the other surface of the film being laminated to an undersheet of higher compliance than the film, and the thickness of the film lying within the range 10 to 50 μm.

It appears that the interpixel spaces are caused by the low compliance of the white thermoplastic film making it highly resistant to deformation by the slight curvature of the head around each pixel's heaters. The area of film in contact with the print head is thus less than that obtained with a more compliant receiver, and the area of pixel transferred is correspondingly less. Although the surface into which the thermal head is pressed, remains film of the same low compliance, the overall compliance of the substrate becomes surprisingly increased when the higher compliance sheet is laminated to its reverse side as an undersheet.

Greater improvement in the overall compliance can be achieved by reducing the thickness of the white film still further, but below about 10 μm it becomes increasingly transparent, and the whiteness is correspondingly lost. It also becomes less effective at removing any surface texture of the undersheet. At the other end of the scale, with molecularly oriented polyester making such a stiff film, very little improvement is seen with film thicknesses greater than about 50 μm. Within this most useful range of 10 to 50 μm range, our preferred thickness for the polyester film is 20 to 30 μm, although the changes outside this range are gradual, and films of different inherent compliances will have different optimal ranges. Surface smoothness better than 1,000 s (Bekk smoothness) generally can be, and preferably is, maintained using polyester films within this range, leading to improved print quality. By comparison, synthetic and (especially cellulosic) papers generally have a greater roughness than that.

The higher compliance undersheet may be a thermoplastic film, such as highly plasticised polyvinyl chloride film. However, with plasticised films in general, there is the danger that plasticiser may migrate into the dye-receptive layer of an underlying receiver sheet while they are stacked awaiting use, unless there is an efficient backcoat to provide an effective barrier. A preferred receiver sheet is one in which the undersheet is a synthetic paper. Another preferred receiver sheet is one in which the undersheet is a cellulose fibre paper.

The laminated substrate can also have further sheets (including films) added to the undersheet. A preferred receiver sheet is one having a thermoplastic underfilm laminated to the higher compliance undersheet on its side remote from the white film carrying the dye-receptive layer. These two films i.e. the underfilm and the film supporting the dye-receptive layer, are preferably both molecularly oriented films made of the same white polyester material giving the resulting receiver sheet a good white appearance on both sides, although this whiteness may be of less importance when the underfilm is added only for the purpose of balancing the laminate mechanically, and a clear film could equally be used to give such balance.

This substrate, i.e. comprising a core of higher compliance material sandwiched between two sheets of similarly lower compliance film, provides a balanced laminate which remains stable when ambient conditions of humidity and temperature, change. Moreover, although this sandwich of film/underlayer/film when using a paper underlayer is the reverse of the paper/-film/paper substrate described in the patent referred to above, its balanced construction will likewise give good resistance to curl, but in addition the outer films will give the improved whiteness and gloss obtainable with this construction.

In addition to the various preformed laminae providing the basis of the substrate, the receiver sheet also has various applied coatings. These include the dye-receptive layer coated onto the white film, and the layers of adhesive between the laminae, bonding them together to form the laminate of the substrate. Similarly, an adhesive subbing layer may be provided between the white film and the dye-receptive layer it supports, this being applied as a coating on the white film before being overcoated in its turn with the dye-receptive coating composition. Subcoats underlying the dye-receptive layer may also be formulated to provide other useful functions, such as, for example, a dye barrier to prevent further penetration of the dye.

Other specialised coatings may be provided as required. One such preferred receiver sheet also has at least one backcoat on its surface remote from the receptive layer. Backcoats can have several useful functions, including improvements to handling and writing properties, and various examples are to be found in the literature of the art. Although these backcoats also provide a balance for the receiver coat, which is beneficial, the absence or presence of such coatings usually makes less difference to the stability of the laminate, than an effective balance in the laminated sheets.

The thickness of the undersheet is not critical as far as achieving the benefits of the present invention is concerned, and the optimum thickness for any particular application is determined more by what thickness of complete receiver is most appropriate for that application, and by the thickness of the one or more layers of film to which it is laminated. Thus when aiming for a target overall receiver thickness of 200 μm, when using two films of 23 μm thickness, an undersheet of about 150 μm would be appropriate, whereas an undersheet of about 100 μm would be more appropriate when using 50 μm thick films.

When evaluating receiver materials, we measured the compliances using standard commercial equipment, and measuring the indentation produced by a 0.395 mm diameter spherical indenter under a load of 10 g. We found that a marked improvement was obtained with receivers giving an indentation of at least 5 μm at 20° C. Whether or not this value is achieved with any particular receiver, is dependent not only on the thickness of the white film (as discussed above) but also on the compliance of the undersheet. We prefer to use as undersheet, materials having a compliance sufficiently high for the indentation produced in a free surface of the material by a 0.395 mm diameter spherical indenter sufficiently high to be at least 10 μm at 20° C. We particularly prefer to use receivers for which the indentations produced in the dye-receptive surface is also at least 10 μm at 20° C.

Receiver sheets according to the first aspect of the invention can be sold and used in the configuration of long strips packaged in a cassette, or cut into individual print size portions, or otherwise adapted to suit the requirements of whatever printer they are to be used with, whether or not this incorporates a thermal print head to take full advantage of the properties provided hereby.

According to a second aspect of the invention, we provide a stack of print size portions of a receiver sheet according to the first aspect of the invention, packaged for use in a thermal transfer printer.

Figure 2:
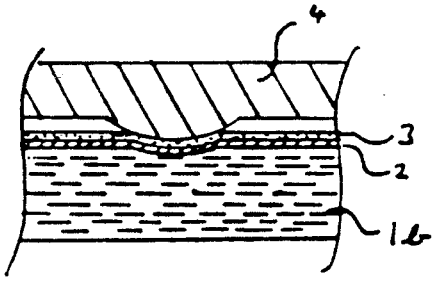
Figure 3:
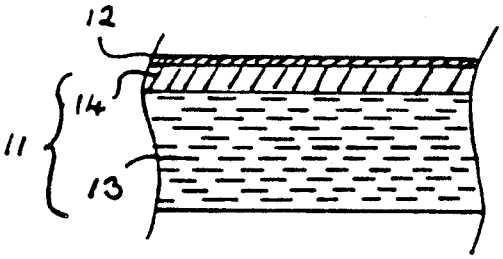
Figure 4:
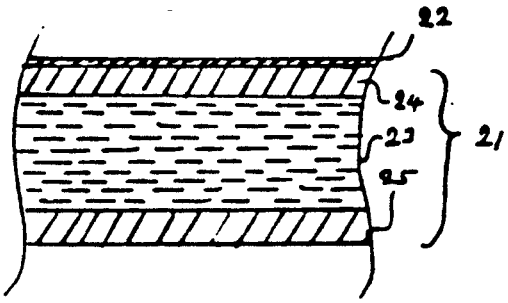

The invention is illustrated by reference to specific embodiments shown in the accompanying drawings, in which:

FIG. 1 is a diagrammatical representation in partial cross section of a dyesheet and low compliance receiver biased against a thermal print head, FIG. 2 similarly shows a dyesheet and high compliance receiver biased against the print head, FIG. 3 is a cross section through a receiver according to the invention, and FIG. 4 is a cross section through a further receiver having a balanced laminate substrate.

Referring first to FIGS. 1 and 2, these illustrate what we have found to happen when using known receivers of different compliances. Each receiver comprises a substrate 1*a*, 1*b* supporting a dye-receptive layer 2. This is used in combination with a thin dyesheet 3, which overlies the receiver as the two sheets pass through the printer, the dyesheet having a dyecoat positioned against the receptive layer 2 of the receiver. This pair of sheets is shown inside a printer, where they are biased against the thermal print head 4. This head has a barely visible domed ridge 5 containing a row of tiny heaters (not shown) running perpendicular to the plane of the section. In FIG. 1 the substrate 1*a* is a sheet of low compliance white thermoplastic film, while that 1*b* in FIG. 2 is a cellulose fibre paper of much higher compliance, the receptive layers being the same in each case.

As mentioned above, we found that the area of a pixel printed on the type of receiver shown in FIG. 1 was less than the area of a pixel printed on that shown in FIG. 2, other parameters being equal. The reason we believe is due to the different areas of contact between the ridge 5 and the sheets. FIG. 2 shows the more compliant receiver being distorted to allow the sheets partly to wrap around the ridge, thus presenting a greater area for heating than the narrow line of contact obtained with the less compliant receiver of FIG. 1.

The receiver sheet shown in FIG. 3 comprises a substrate 11 supporting a layer of dye-receptive material 12. The substrate is a laminate of a cellulose fibre paper 13, essentially as shown in FIG. 2, and a white glossy thermoplastic film 14, essentially as shown in FIG. 1, with the film interposed between the receptive layer and the paper.

A balanced laminate sheet is shown in FIG. 4. In this a substrate 21 supports a dye-receptive layer 22. The substrate again has an upper film 24 and an undersheet of paper 23, but differs from that in FIG. 3 in having a further undersheet of white film 25.

The invention is further illustrated by the following Examples:

EXAMPLE 1

A sample of receiver sheet was prepared as shown in FIG. 3, in which the film was white Melinex 990 film, 50 μm thick, and the paper was Yupo FPG 150 paper, 150 μm thick. The print quality of the laminated receiver was found to be a little better than that obtained on plain Melinex 990 film, good, with pixel size (when viewed though a microscope) being a little larger, suggesting that the during printing the receiver behaved a little more like that shown in FIG. 2.

To quantify the effect of using laminated receivers, and to evaluate the effect of using an even thinner film, a series of measurements were carried out as described in the following examples.

EXAMPLES 2-8

To compare the compliance of receivers according to the invention with unlaminated sheets, a series of receiver sheets was prepared in the configuration shown in FIG. 4. The compliant layer was a synthetic paper, Yupo FPG, and was used in various thicknesses, from 60-200 μm, to provide the series of different samples. On both sides of this paper were laminated low compliance white sheets of Melinex 990 film, 23 μm thick, one of these being coated with a dye-receptive material on its outer free surface. All the laminates were prepared using an adhesive between the sheets.

All samples were tested on a Wallace Micro Indentation Tester, type H7A. This used a 0.395 mm diameter spherical indenter, which was placed on the sample to be tested. The system was then zeroed under a light loading of 0.25 g. The test load of 10 g was then applied, and the depth of indentation determined. These tests were carried out on both the uncoated surface, and that coated with dye-receptive material, the results obtained being given in Table 1.

COMPARATIVE EXAMPLES A-G

For comparison, samples of the various thickness of synthetic paper used in construction of the laminates, were also measured in like manner. Of these, synthetic paper having a thickness of 150 μm, is itself sometimes used commerically as a receiver sheet substrate. The white Melinex film was also separately tested, in two thickness, 125 μm and 23 μm. In the former thickness, such film can be used on its own as a receiver substrate, whereas the thinner material is preferred for the laminates, to avoid the receiver sheet becoming impracticably thick.

As a further comparison, a receiver was tested having a substrate laminated from three papers, all 60 μm thick. The outer sheets were both synthetic paper (Yupo FPG 60), and the inner sheet was a cellulose fibre paper.

TABLE I

| Example | Sheet thickness μm paper | Sheet thickness μm film | Identation μm receiver side | Identation μm free side |
|---|---|---|---|---|
| 2 | 60 | 23/23 | 11.5 | 12.5 |
| A | 60 | — | | 13.5 |
| 3 | 110 | 23/23 | 10.75 | 14.5 |
| B | 110 | — | | 14.75 |
| 4 | 150 | 23/23 | 12.5 | 14.25 |
| C | 150 | — | | 16.0 |
| 5 | 200 | 23/23 | 10.5 | 11.0 |
| D | 200 | — | — | 11.25 |
| E | — | 125 | — | 2.5 |
| F | — | 23 | — | 3.25 |
| G | 60/60/60 | — | — | 12.75 |

These results confirm the more subjective analysis of the prints made on receiver sheets containing cellulose fibre paper, and described above with reference to FIGS. 3 and 4, in that compliant papers gave similar good print quality irrespective of whether they had a superimposed thermoplastic film. These indentation tests give correspondingly similar results, and the markedly lower compliance of the straight films give much lower penetrations in Examples E and F.

Improvement in print quality can be obtained increasingly as the compliance increases to give indentations greater than about 5 μm, when measured as above. Preferred substrates are those giving indentations greater than 10 μm.

However, the laminates of Examples 2-5 looked much whiter than the papers, so to test this quantitatively, three representative receiver sheets were tested for whiteness and gloss as described below. The three sheets measured were the balanced laminate of Example 2, the white plastic film of Example E, and the synthetic paper of Example A.

Whiteness: This was determined using a standard Minolta colorimeter. CIE (1976) colour difference coordinates L*, a* and b* were measured, and the results obtained are quoted in Table II below. Of these the high b* value obtained with the synthetic paper confirms its undesirable yellow appearance, which is effectively masked in the laminated receiver. Receivers having both a* and b* colour coordinate values less than 1.0, are preferred.

Gloss: Values for the gloss of the three samples was measured on a GMX 202 glossmeter marketed by Murakami Colour Research Laboratories, and the results are similarly recorded in Table II. Values greater than 90%, are preferred for producing attractive prints, and the values recorded in the table below again confirm the earlier subjective view, that the laminated receiver sheet retains the high gloss of the white plastic films. This is in marked contrast to the much lower gloss value obtained for the synthetic paper.

TABLE II

| Example | Substrate | Whiteness L* | Whiteness a* | Whiteness b* | Gloss % |
|---|---|---|---|---|---|
| 2 | laminate | 92.44 | −0.08 | −0.71 | 101.5 |
| E | film | 93.49 | −1.14 | −0.14 | 102.7 |
| A | paper | 96.30 | +0.39 | +2.29 | 54.5 |

Inter-pixel gap: After printing a standard test pattern onto each of the same three samples using a commercially available video printer (Sharp), each print was examined by microphotography. The results are given in Table III, and a direct correlation with the compliance measurements on the same materials can be seen.

TABLE III

| Example | Substrate | Interpixel gaps |
|---|---|---|
| 2 | laminate | Not visible |
| E | film | Clearly visible |
| A | paper | Not visible |

EXAMPLES 6–8, AND COMPARATIVE EXAMPLE H

In Examples 6 and 8, the same tests were carried out on receivers using as the undersheet a cellulose fibre paper, Kokuyo KB, instead of the Yupo synthetic papers, although the former is retained in Example 7 as a control. As a further control, Kokuyo KB paper was used on its own in Comparative Example H. The results were as shown in Tables IV, V and VI below.

TABLE IV

| Example | Substrate film μm | Substrate paper | Substrate film μm | Identation μm receiver side | Identation μm free side |
|---|---|---|---|---|---|
| 6 | 50 | Kokuyo KB | 50 | 5.44 | 5.84 |
| 7 | 50 | Yupo 60 | 50 | 5.34 | 6.36 |
| 8 | 23 | Kokuyo KB | 23 | 9.78 | 12.2 |
| H | — | Kokuyo KB | — | | 11.62 |

TABLE V

| Example | Substrate | Whiteness L* | Whiteness a* | Whiteness b* | Gloss % |
|---|---|---|---|---|---|
| 6 | laminate | 92.45 | +0.25 | −0.27 | 104.4 |
| 7 | laminate | 93.11 | +0.05 | +0.20 | 101.7 |
| 8 | laminate | 91.19 | +0.09 | −0.64 | 103.9 |
| H | paper | 93.51 | +0.47 | +1.52 | |

TABLE VI

| Example | Substrate | Interpixel gaps |
|---|---|---|
| 6 | laminate | Visible |
| 7 | laminate | Visible |
| 8 | laminate | Not visible |

As had been achieved with the synthetic paper undersheet, this cellulose fibre undersheet gave a laminate of similarly improved compliance, as is evidenced from th result above, and the improved whiteness of the laminate compared with the uncovered paper can again be seen from the much lower b* values obtained.

As may be expected, the Bekk smoothness values correspond well with the gloss reading obtained above. Samples of Kokuyo cellulose paper gave Bekk smoothness measurements of 50 to 100 s, and samples of Yupo synthetic paper gave readings of 3,000 to 5,000 s. However, samples of all the above laminates using these papers as underlayers, all gave values greater than 10,000 s.

We claim:

1. A receiver sheet for dye diffusion thermal transfer printing comprising a white molecularly oriented polyester film supporting a layer of dye-receptive material on one surface, characterised in that the other surface of the film is laminated to an undersheet of higher compliance than the film, and the thickness of the film lies within the range 10 to 50 μm.

2. A receiver sheet as claimed in claim 1, characterised in that the thickness of the polyester film lies within the range 20 to 30 μm.

3. A receiver sheet as claimed in claim 1, characterised in that the undersheet is a synthetic paper.

4. A receiver sheet as claimed in claim 1, characterised in that the undersheet is a cellulose fibre paper.

5. A receiver sheet as claimed in claim 1, characterised in that it also has an underfilm laminated to the higher compliance undersheet on its side remote from the white film carrying the dye-receptive layer.

6. A receiver sheet as claimed in claim 5, characterised in that the underfilm and the film supporting the dye-receptive layer are both molecularly oriented films made of the same white polyester material.

7. A receiver sheet as claimed in claim 1, characterised in that the indentation produced in the dye-receptive surface by a 0.395 mm diameter spherical indenter under a load of 10 g, is at least 5 μm at 20° C.

8. A receiver sheet as claimed in claim 7, characterised in that the undersheet is a material having a compliance sufficiently high for an indentation produced in a free surface of the material by a 0.395 mm diameter spherical indenter under a load of 10 g, is at least 10 μm at 20° C.

9. A stack of print size portions of a receiver sheet as claimed in any one of the preceding claims, packaged for use in a thermal transfer printer.

* * * * *